United States Patent [19]

Gründler

[11] Patent Number: 5,052,080

[45] Date of Patent: Oct. 1, 1991

[54] METHOD AND APPARATUS FOR CONTROLLING YARN PREPARATION OPERATIONS TO ENHANCE PRODUCT UNIFORMITY

[75] Inventor: Christoph Gründler, Winterthur, Switzerland

[73] Assignee: Maschinenfabrik Rieter, AG, Winterthur, Switzerland

[21] Appl. No.: 366,518

[22] Filed: Jun. 15, 1989

[30] Foreign Application Priority Data

Jun. 23, 1988 [DE] Fed. Rep. of Germany ..... 3821238

[51] Int. Cl.[5] ..... D01B 3/04

[52] U.S. Cl. ..... 19/65 A; 19/98; 19/105; 19/236; 19/238; 19/239; 19/240

[58] Field of Search ..... 19/65 A, 98, 66 R, 105, 19/236, 238, 239, 240

[56] References Cited

U.S. PATENT DOCUMENTS

| | | | |
|---|---|---|---|
| Re. 27,967 | 4/1974 | Binder et al. | 222/55 |
| 3,709,406 | 1/1973 | Binder et al. | 222/55 |
| 3,821,833 | 7/1974 | Wildbolz et al. | 19/66 R |
| 3,881,222 | 5/1975 | Roberson | 19/66 R |
| 4,030,635 | 6/1977 | Hablutzel et al. | 222/55 |
| 4,133,455 | 1/1979 | Moser | 222/77 |
| 4,161,052 | 7/1979 | Erben | 19/240 |
| 4,184,361 | 1/1980 | Erben | 19/240 |
| 4,527,306 | 7/1985 | Thannheiser | 19/66 CC |
| 4,539,729 | 9/1985 | Meile et al. | 19/288 |
| 4,709,451 | 12/1987 | Leifeld | 19/105 |
| 4,776,066 | 10/1988 | Leifeld | 19/105 |
| 4,779,310 | 10/1988 | Leifeld | 19/105 |
| 4,779,311 | 10/1988 | Leifeld | 19/105 |
| 4,860,406 | 8/1989 | Staheli et al. | 19/105 |
| 4,864,694 | 9/1989 | Konig et al. | 19/240 |

FOREIGN PATENT DOCUMENTS

| | | |
|---|---|---|
| 329412 | 5/1976 | Austria . |
| 271115 | 12/1987 | European Pat. Off. . |
| 275471 | 12/1987 | European Pat. Off. . |
| 1637846 | 4/1957 | Fed. Rep. of Germany . |
| 1069510 | 11/1959 | Fed. Rep. of Germany . |
| 2031788 | 2/1972 | Fed. Rep. of Germany . |
| 2050111 | 2/1972 | Fed. Rep. of Germany . |
| 1918544 | 4/1975 | Fed. Rep. of Germany . |
| 2506061 | 4/1979 | Fed. Rep. of Germany . |
| 2359917 | 5/1979 | Fed. Rep. of Germany . |
| 3228672 | 2/1984 | Fed. Rep. of Germany . |
| 3535684 | 4/1987 | Fed. Rep. of Germany . |
| 3617525 | 11/1987 | Fed. Rep. of Germany . |
| 3617527 | 11/1987 | Fed. Rep. of Germany . |
| 496926 | 4/1969 | Switzerland . |
| 661291 | 10/1983 | Switzerland . |
| 1285080 | 1/1987 | U.S.S.R. . |
| 2119104 | 11/1983 | United Kingdom . |
| 2151811 | 9/1984 | United Kingdom . |

OTHER PUBLICATIONS

German Utility Model No. 1,637,846 4/52

*Primary Examiner*—Werner H. Schroeder
*Assistant Examiner*—Michael A. Neas
*Attorney, Agent, or Firm*—Burns, Doane, Swecker & Mathis

[57] ABSTRACT

In a method and a apparatus for producing continuous slivers of improved uniformity, open-loop or closed-loop control of the production process is corrected in dependence upon the absolute air humidity measured near the installation. Long-term variations in sliver weight, which have been found to correlate with the absolute air humidity, are obviated.

18 Claims, 5 Drawing Sheets

METHOD AND APPARATUS FOR CONTROLLING YARN PREPARATION OPERATIONS TO ENHANCE PRODUCT UNIFORMITY

FIELD OF THE INVENTION

The invention relates to the production of continuous slivers of improved uniformity. It is concerned particularly with methods and apparatus for producing improved uniformity in slivers in textile facilities where laps produced from fiber flocks are supplied to cards and converted thereby, and where drawframes and possibly other apparatus disposed thereafter draft the carded product and provide slivers of a desired count or weight per unit length. The invention deals with the effects of humidity variations in the environments for such systems.

BACKGROUND

Over many years suggestions have been made to improve the uniformity of a sliver delivered by a card or a drawframe and to keep very closely to a required sliver count. Maintaining a predetermined sliver count at the exit of the card or drawframe is very important for subsequent production of the yarn. The quality and value of the spun yarn depend upon its uniformity, and this can be impaired considerably by failure to maintain the required sliver count after the card or drawframe. Variations in sliver count may lead to frequent interruptions in subsequent processing, leading to expense and impairment of the value of the spun yarn.

Many suggestions have already been made for controlling a card (or the stock chute feed usually disposed before the card) to ensure that the card delivers a very uniform sliver. For example, West German patent document DE-AS 1 069 510 discloses the provision of a vibrator on the vertical chute of a stock chute feed in order to maintain the filling height in the chute permanently at a level such that a downwardly increasing pressure is exerted on the fiber material by weight of the column of fibers. The aim of this is to achieve a substantial uniformity of the sliver by creating a definite exit condition in the chute and thus to avoid substantial variations of the sliver count.

DE-AS 1 918 544 (counterpart of U.S. Pat. No. 3,821,833) proposes a method of pneumatic feeding of flock to a card in which suspended fiber flocks are conveyed by a stream of conveying air through a conveying line to the filling chute of the stock chute feed and deposited therein. The distinguishing feature of this method is that the moisture content of the conveying air is adjusted. In dependence upon the measurement of humidity, a small quantity of air (which has been separated from the conveying air stream, is free from flocks and water droplets and has been conditioned by mixing with water or water vapor) is added to said stream. This method, which already represents a closed-loop control, has as one of its aims to control humidity in the conveying system and thus obviate disturbing agglomerations of flock, so that the conveyed fiber material is deposited uniformly in the chute and the count of the sliver delivered by the card is beneficially affected.

DE-OS 2 050 111 (counterpart of U.S. Pat. No. Re. 27,967) also relates to a closed-loop control aimed at ensuring a very uniform stock at the exit of the chute of a stock chute feed. To this end, the pressure gradient acting on the column of flock is varied, in dependence upon a deviation measured on the passing fiber structure delivered by the chute, from the reference weight per unit of length. Such regulation of the pressure gradient tends to counter the measured deviation.

Another form of closed-loop control of flock feeding is suggested in DE-OS 2 031 788. It is known from this West German patent document to move the lap delivered by the take-off rollers at the bottom end of the chute over a weighing facility in order to ascertain the deviation from a reference weight. The deviation is then used to vary the speed of a motor driving inter alia the take-off rollers.

DE-AS 2 359 917 (counterpart of U.S. Pat. No. 4,030,635) relates to an improvement in the control method described in DE-OS 2 050 111 (counterpart of U.S. Pat. No. Re. 27,967), in which the pressure acting on the flocks in the chute is also controlled in order to inhibit variations in the delivered lap. The control method is so devised as to eliminate the effect of manufacturing and/or assembly tolerances in the measuring rollers used to measure lap thickness. The deviations detected are integrated at time intervals coinciding with the time taken for one complete revolution of one of the delivery rollers, the pressure gradient in the chute being controlled in dependence upon the integrated values obtained.

DE-PS 2 506 061 (counterpart of U.S. Pat. No. 4,133,455) describes a weighing facility suitable for determining deviations of the lap from the set or reference value in a method according to DE-OS 2 031 788.

European application 87 118 415 describes an ingenious open-loop control of a card in which a signal dependent on the thickness of the lap fed to the card is used to control the feed roller preceding the taker-in of the card. A similar arrangement, but in the form of a closed-loop control of the card, is described in the simultaneously filed European application 87 118 414.9 in which a signal dependent upon lap density is produced at the card exit and is additionally taken into account in the control of feed roller speed.

Despite all these steps, it is still possible for the sliver weight at the exit of the card or of a subsequent drawframe not to be completely uniform over a prolonged period of time—i.e., it is impossible to maintain a predetermined sliver count completely accurately over a prolonged period of time.

OBJECTS AND SUMMARY OF THE INVENTION

It is an object of this invention to provide an open-loop or closed-loop control for textile apparatus enabling the production of more uniform slivers at the exit of a card or of a drawframe and enabling a required sliver count to be maintained.

Another object of this invention is to provide cotton sliver production control methods and apparatus for obviating objectionable cotton sliver irregularities stemming from long term humidity variations in the textile plant or mill in the vicinity of the sliver production machines.

A more particular object of the invention is to improve control systems of the closed loop and open loop types that have been employed heretofore to minimize sliver weight variations by superimposing on such systems a control function derived from humidity measurements tracking changes in the ambient conditions over relative long time intervals.

After years of experience with cards in widely differing areas of the world, it has now been realized that in installations comprising a number of simultaneously operating cards, there are sliver count variations (not brief variations but long-wave variation trends extending over several hours) which occur despite ingenious controls and which correlate well with one another in time. When the sliver count of one card overshoots the required set value, a similar increase is detectable in other cards at the same plant. Considered individually, such variations could arise for a number of reasons but the close correlation is initially surprising. An aspect of the present invention is a discovery that these variations correlate well in time with long-term variations of the prevailing humidity of the air and more particularly the "absolute air humidity" (the term used herein to refer to the weight of the water in a given weight of air).

One explanation for this behavior is that the sliver becomes "more pliable" with increasing air humidity—i.e., it has less natural stiffness—so that a given pressing force of the measuring rollers at the card exit produces a thinner sliver than when air humidity is less although the number of fibers per cross-section—i.e., the sliver weight—are the same in both cases. In the light of this determination of an apparent reduction in sliver thickness, the infeed at the card entry increases, so that in fact more fibers per cross-section enter the machine.

To make this more readily understandable, a chute full of fibers at an air humidity x can be imagined, a predetermined downwards pressure being exerted on the fibers. If the humidity in the fibers is increased by any means, a given force can compress them, for example, by half, something which corresponds volumetrically to half the original fiber volume, but the quantity of fibers is the same.

The inventor has also realized that these variations can to a considerable extent be eliminated by the steps according to the invention. The invention can provide an improvement even in simple installations in which lap thickness at card entry is subjected just to open-loop control and not to closed-loop control. If a simple correction proportional to the absolute air humidity is introduced in the open-loop control, a substantial improvement can be achieved in the uniformity of the resulting sliver and, therefore, in the quality and value of the spun yarn.

It is of course conventional to provide a drawframe after the card installation, drawframes normally combining a number of slivers so that a doubling occurs. This is entirely possible when the invention is used. The slivers from a number of cards can be supplied simultaneously and directly to a drawframe since the reduction in long-wave variations always ensures a uniform product at the drawframe exit. It is therefore unnecessary to double slivers from different cans in order to even out different sliver counts. Since the slivers from a number of cards can be fed to a drawframe simultaneously, an end product having an accurately predetermined composition can be provided more readily since this composition is present simultaneously in all the cards.

Although the method according to the invention is of use with card installations which are not subject to closed-loop control but which have open-loop control at their entry to ensure uniform slivers, it is preferred, in an installation having a stock chute feed, a card and possibly a drawframe, for at least one of these elements of the installation to be subject to a closed-loop control operation and for the correction according to the invention to be superimposed thereon. The correction can be effected more particularly in the form of a disturbance variable feedforward. Since a disturbance variable feedforward can be regarded as an addition to an existing closed-loop control. Existing closed-loop controls can have the closed-loop control according to the invention added subsequently without any need for extensive alteration of the installation. Also, disturbance variable feedforward is a cheap form of control and so the correction according to the invention does not necessarily entail greatly increased installation costs.

Another possibility is for the cards or card-feeding facilities or drawframes thus controlled to be controlled by measured-value signals produced by means of a pressing of the lap. Similar considerations apply to open-loop and closed-loop controls with a disturbance variable feedforward, regulatable by signals produced by pressing of the lap. In such a case the resulting signal is corrected for humidity variations in accordance with the invention.

As previously mentioned, the sliver count variation caused by the absolute air humidity can be regarded as a long-wave alteration. To take account of this fact in accordance with the invention, an average is formed from the absolute air humidity measured either continuously or at regular time intervals and the correction is effected in dependence upon progressive variations in the average.

This method has the advantage that the installation is not overcorrected in response to brief variations of the absolute air humidity, something which might make the control unstable. In such installations having a number of cards the same correction can be used for all the cards, or all the flock chutes or all the drawframes. In other words, all that is necessary is to provide a single air humidity measuring facility for an installation having a number of cards, thus obviating any substantial increase in the costs of the complete installation.

In a system for the practice of the method in an installation having a stock chute feed, a card disposed thereafter and possibly a drawframe disposed after the card, the invention is distinguished by: at least one facility disposed near the installation and adapted to measure the existing absolute air humidity; and an open-loop or closed-loop control for controlling the installation in dependence upon the variations detected by the said facility in the average absolute air humidity. It is particularly preferred that correction in accordance with the invention be integrated with existing closed-loop and/or open-loop controls.

BRIEF DESCRIPTION OF THE DRAWINGS

The invention will be described below with reference to certain embodiments illustrated in the accompanying drawings, wherein.

DETAILED DESCRIPTION OF PREFERRED EMBODIMENTS

Figure 1:
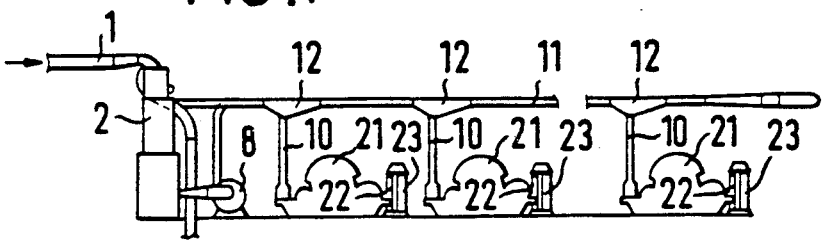
FIG. 1 is a side elevation of a card installation having a number of cards.

FIGS. 1-6 correspond to FIGS. 1-6 of DE-OS 2 050 111 but with the addition of the correction according to the invention. Referring to FIGS. 1-5, a fiber material from a blowroom is supplied through a feed line 1 by means of a conveying air stream to a stock chute feed 2. By means of a screening drum (not shown) disposed in a suction box at the top end of the device 2 the fiber material is separated and discharged to a reserve chute 4 best seen in FIG. 5.

The fiber material from the chute 4 goes, by way of a nip bounded by a feed roller 5 and a pedal lever clamp 6, to a beater 7. This may be a Kirschner beater, for example, which breaks up the fiber material into fine open flocks or tufts.

Figure 5:
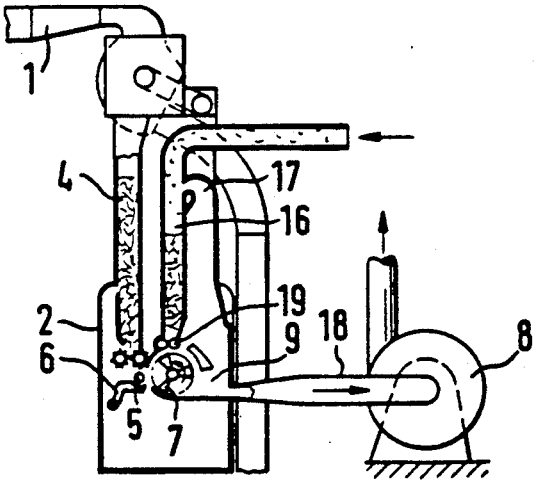
FIG. 5 is a section through a stock chute feed used in the installations shown in FIGS. 1 and 3.

A conveying fan 8 extracts the flocks and conveying air from chamber 9 and supplies them as a continuous stream of flocks to a conveying line 11 which extends in the shape of a U over two rows of three cards and finally returns them to the chute feed 2. A vertical chute 10 is disposed before each card and is at a positive pressure P1. Each chute 10 communicates at the top by way of a separating head 12 (visible in FIG. 6) with the line 11, and the flocks are deflected from the flow of flocks through the head 12 down into the chute 10. This continues until the column of flocks in the chute 10 has reached the level of the head 12 and, therefore, a height h in FIG. 6. Each chute 10 is formed at its bottom end with a gap 15 (visible in FIG. 6) opposite bottom draw-off rollers 13 and 14—i.e., the chute 10 is not sealed off hermetically at the bottom from the spinning mill environment around it. Because of the effect of the medium being conveyed, which is at the positive pressure P1 (the ambient pressure in the spinning mill = P0 < P1), a pressure gradient ΔP is effective in the chute 10 between the bottom end thereof and the top of the flock column H, such pressure gradient compressing or condensing the column. Consequently, all the flock-filled chutes experience the effect of the pressure gradient P. The filling of flock keeps the gap 15 narrow. The conveying air, to the extent that it is not lost through the air outlet gap 15 at the bottom end of the chute, returns together with surplus material into return chute 16 of the stock chute feed 2, as can be seen in FIG. 5.

The conveying air returns to the chamber 9 by way of an air passage 17 having an appropriately disposed entry. It then goes to the inlet of the fan 8, whereas the flocks remain in the return chute 16 until they are conveyed by the continuously driven dispensing rollers 19 (while avoiding any nip), to the beater 7 and then to the fan inlet 18 from which they enter the circuit.

Figure 2:
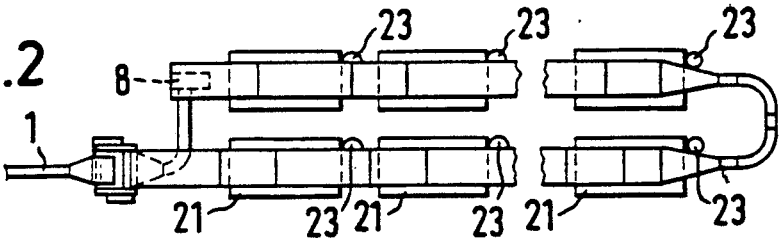
FIG. 2 is a plan view of the installation shown in FIG. 1.
Figure 3:
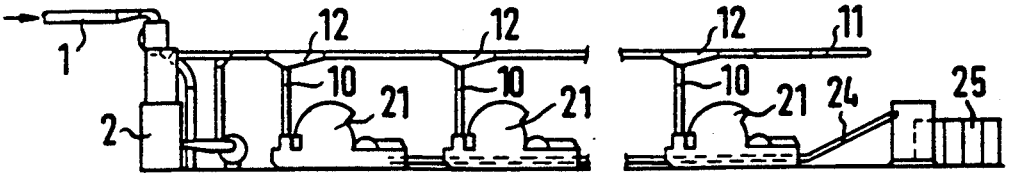
FIG. 3 shows a variant of the installation of FIG. 1 with a drawframe disposed after the card.
Figure 4:
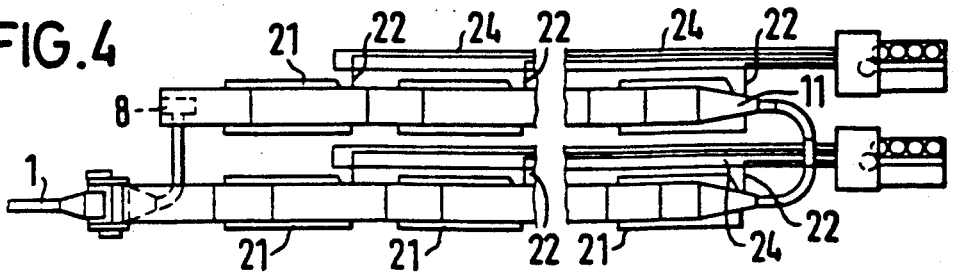
FIG. 4 is a plan view of the installation shown in FIG. 3.

The lap delivered by the take-off rollers 13 and 14 at the bottom end of each chute 10 (FIG. 6) is fed to the card 21 which is associated with the chute 10 and which produces a sliver 22 which can go either in to a can 23 (as shown in FIGS. 1 and 2), or onto a storage belt (not shown) for a belt conveyance system, such as that represented by the conveying belt 24 shown in FIGS. 3 and 4. The belt 24 extends along the row of cards, and the slivers 22 placed consecutively one beside another on the belt 24 are supplied together to a drawframe 25.

The flock column in the chutes is compressed more (in proportion) as the pressure gradient ΔP acting on the column is greater. This state of affairs can be sensed as the lap arrives at the draw-off rollers 13 and 14 of the chute 10 (FIG. 6) because of the displaceable mounting of the spring-biased roller 14. Sensor means 26 is connected to the roller 14 and provides an output electrical signal proportional to the deviation from the set-value or reference position. The signal goes to a controller 27 which varies the speed of motor 28 of fan 8 (FIG. 5). That is, it adjusts the final control element of the control loop, and therefore the positive pressure P1, until the difference between the set value and actual value of the lap drops to zero. The controller 27 preferably is a commercially available controller so designed that, in addition to the proportional feature, an integral (and, if required, a PID— i.e., proportional, integral, derivative—behavior) can be provided.

Consequently, the compression of the flock column in the chute is varied by variation of the positive pressure P1. Variations in the weight of the lap 20 are eliminated substantially without inertia since such variations are detected at the earliest possible place—i.e., as early as the exit of the chute 10—and the flock column reacts immediately to the increased pressure in the conveying line by increased compression of the discrete flocks in the complete column, right down to the lowest region thereof. The flock column behaves like a spring which has a non-linear characteristic and which is compressed. Even in the lowest column part immediately before the draw-off rollers, the column is compressed in the same proportion disregarding friction on the chute walls and the effect of gravity. The system therefore operates with negligible delay.

When a number of chutes are connected to a common conveying line, it is completely satisfactory if conveying fan speed is controlled from a single chute so that the compression in all the flock columns is varied jointly up or down. This leads to the important advantage of central closed-loop control with a reduced outlay. Advantageously, two or three of the chutes connected to a conveying line each has a sensor whose signal can be changed over to the controller 27 if the sensor then in use is at that time associated with a stopped chute.

The arrangement described above corresponds to the closed-loop control suggested in DE-OS 2 050 111 (counterpart of U.S. Pat. No. Re. 27,967). According to the invention, a measuring facility or sensor 30 is provided in the spinning mill near the sliver processing machinery. For example, the sensor 30 may be located adjacent the chute 10. It measures the air humidity and converts it into a continuous electrical output signal injected into a line 31.

Since direct measurement of absolute air humidity is relatively costly, preferably both the relative humidity and the temperature are measured and the absolute air humidity determined from them, something which can be done with sufficient accuracy, for example, in a microprocessor. Suitable appliances, including absolute moisture sensors and sensors and transmitters for relative humidity and temperature, are readily available commercially, such for example as those sold under the Panametrics designation.

An electronic timer 32 samples the air humidity signal delivered to the line 31 at regular time intervals, the discrete values being read into a memory 33. The same has an interface 34 by which a microprocessor can be connected to the memory as required to record air humidity values over a long period, something which is sometimes very desirable, more particularly in fully automatic installations or installations having central data collection.

An average former 35 forms at the cadence of the timer 32 an average from the values stored in the memory 33. It has been found that an average advantageous for control purposes is provided if a new average is formed at fairly short intervals (e.g., about 0.5–2 minutes) from values accumulated over a much longer interval (e.g., about 20–40 minutes). Forming a new average once a minute from the values accumulated in the previous thirty minutes is a desirable pattern, for example. It is sufficient for the timer 32 to sense the output signal of the facility 30 at intervals of about 0.5–2 minutes, with sensing once a minute being preferred. In this case the average former 35 summates the last thirty values stored once a minute and delivers the result as output signal to one input 36 of a divider 37. A second input 38 thereof is a setting input and receives from the nominal value setter 39 a nominal value representing, for example, the air humidity in an air-conditioned spinning room of the factory, viz., the air humidity at which the installation was first calibrated.

If the average former 35 merely adds the values in the memory 33 to form an average and does not divide them by the number of added values, the nominal value must be increased in accordance with the number of summated air humidity values from the memory 33.

The divider 37 then divides the nominal value at the second input 38 by the average at the input 36, and sends the result by way of a line 40 to a multiplier 41 disposed between the controller 27 and the fan motor 28. The multiplier 41 multiplies the output of the controller 27 by the signal value obtained by the divider 37 and thus corrects the fan feed pressure P1. The reason for the divider 37 dividing the reference value by the average instead of the other way round is that the fan pressure P1 has to be reduced for an increase in absolute air humidity and, vice versa, increased for a reduction in absolute air humidity.

However, the average could of course be divided by the reference value and the multiplier 41 replaced by a divider. Also, of course, if a microprocessor is used for the closed-loop control as is now conventional, the values go directly from the facility for measuring air humidity to the microprocessor where they can be processed in accordance with the programming thereof. In this case the nominal value can be regarded as a special input to the microprocessor; however, it can be contained therein in the form of a read-only memory. The important consideration is that in working out the controlled condition for the motor 28 the microprocessor should take account of variations in absolute air humidity.

Figure 6:
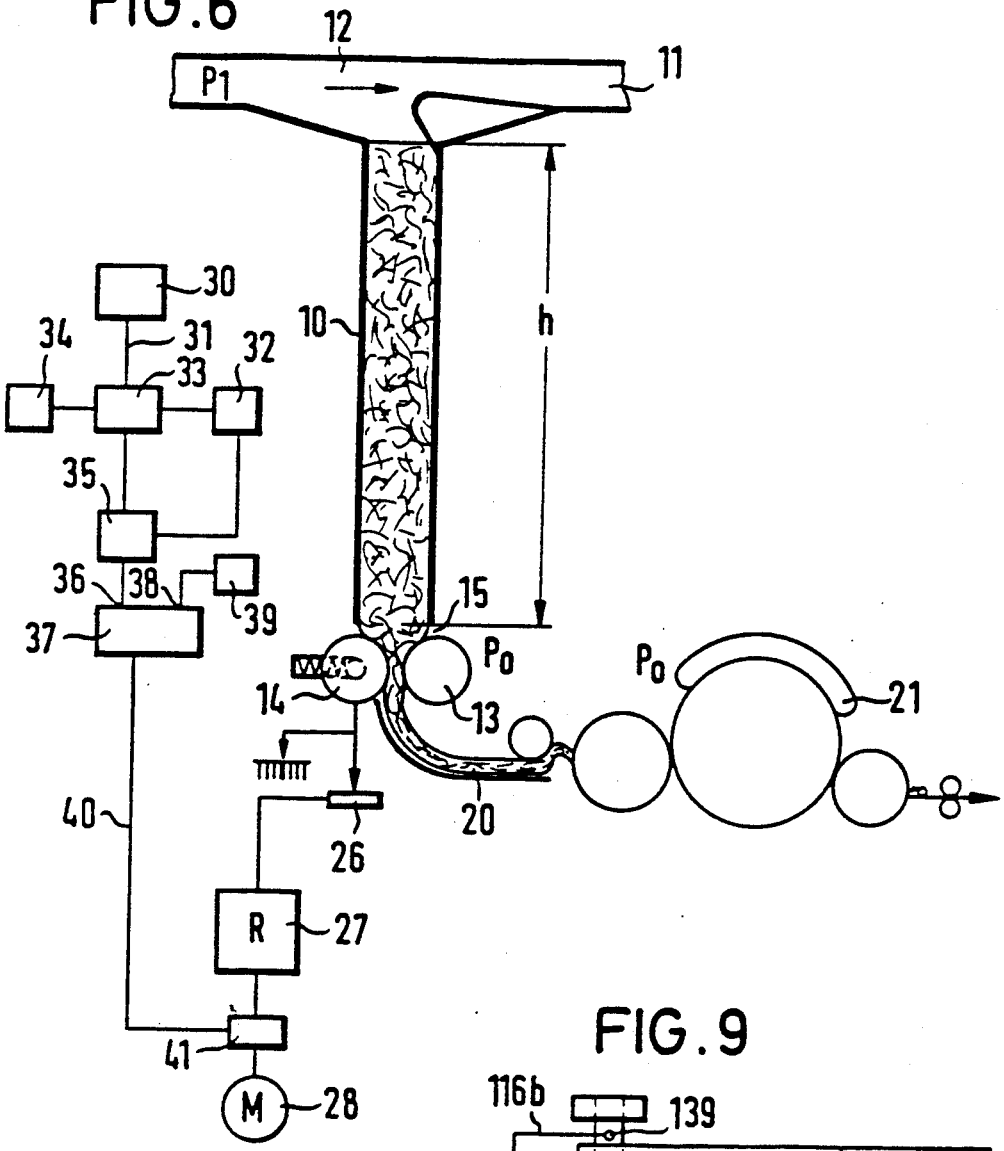
FIG. 6 is a diagrammatic view of a closed-loop control system for use in the installations of FIGS. 1 and 3.
Figure 7:
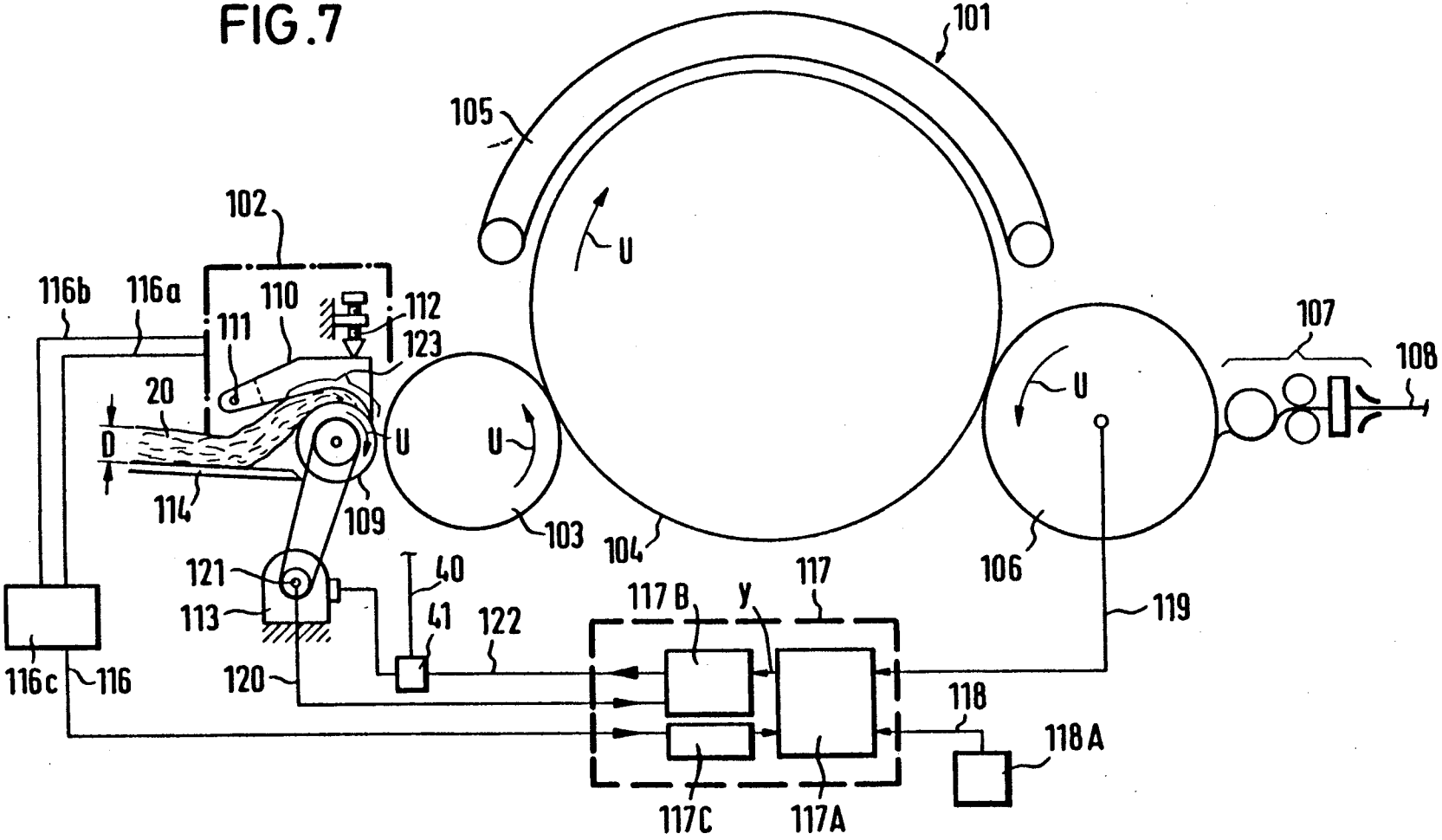
FIG. 7 is a diagrammatic side elevation of a card having open-loop control in accordance with European patent application 87 118 415.6, but modified in order to be able to make the correction according to the invention.

In the embodiment shown in FIG. 6 the card which follows the feed chute is itself set up so that the drafts and speed relationships or speeds of the discrete components of the card are preset. However, the card can be devised in the manner described in European patent applications 87 118 415.6 and 87 118 414.9 respectively, so as to permit corrections in dependence upon absolute air humidity to be made by action to change feed roller speed, instead of the speed of the fan 8. FIG. 7 illustrates a first possibility of making this correction through the agency of the feed roller.

The card 101 which is shown in FIG. 7 and which has open-loop control comprises, from left to right in FIG. 7, a fiber feed unit 102 (shown in chain-dotted line), a taker-in 103, a swift 104 with flats 105, a doffer 106 and a web-condensing unit 107 adapted to form a sliver 108. The feed unit 102 comprises a rotatable and driveable feed roller 109 and, cooperating therewith, a trough plate 110 mounted for pivoting around a pivot The feed roller 109 is fixedly arranged and the pivotability of the trough plate 110 is limited by an adjusting screw 112 in the direction away from the roller 109 and by an abutment in the opposite direction. A geared motor 113 drives the feed roller 109.

In operation the lap 20 is supplied from the exit end of the chute 10 of the embodiment of FIG. 6 on a feed plate 114 to the feed unit 102. Due to the roller 109 rotating in the direction U, the lap is in known manner fed as a compressed lap to the much faster running taker-in 103.

The web which has been processed between the swift 104 and the flats 105 is removed by the doffer 106 and conveyed to the condensing unit 107 in which the web is condensed to form the sliver 108. The ratio of the surface speed of the doffer 106 to the surface speed of the feed roller 109 is the drafting ratio of the card.

The entry of the lap 20 pivots the plate 110 away from the feed roller 109 into engagement with the adjusting screw 112. This position of the plate 110 will hereinafter be referred to as its operative position. Consequently, the compacting or condensing action imparted to the lap 20 between the plate 110 and the feed roller 109 can be determined by means of the screw 112. This clamping action produces measurable parameters, to be described hereinafter, in the feed unit 102 which make it possible to obtain continuously a signal 116 corresponding to the density of the "clamped" lap 20.

Figure 9:
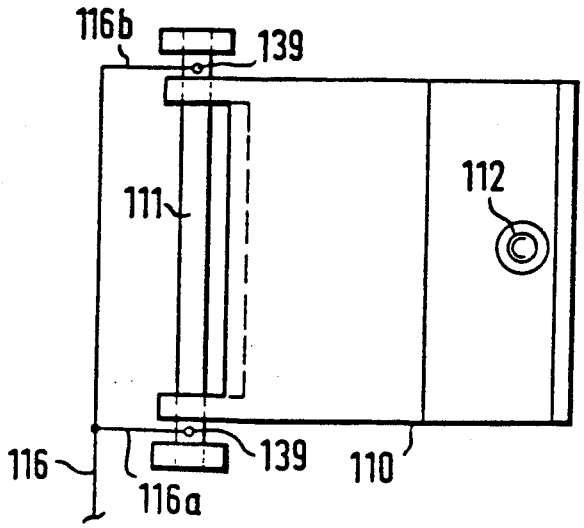
FIG. 9 shows how important measured values for the closed-loop control of FIGS. 7 and 8 can be obtained.

To obtain the signal 116 as shown in FIG. 9, two signals **116*a* and 116*b* provided by the outputs of strain gauges 139 disposed on the left and right of pivot 111 for plate 110 are used. These detect the transverse force of the bearing pivots of the feed trough. The signals 116*a* and 116*b* are applied to a measurement amplifier 116*c* which first adds and then amplifies the signals to give the signal 116 representing an amplified average-value signal. The amplifier 116*c*** converts the signals of the strain gauge receivers into a DC voltage between −10 and +10 volts.

The signal 116 is input to an open-loop control 117 together with a manipulated or manually set input signal 118 for lap thickness, a speed signal 119 of the doffer 106 and a speed signal 120 of the shaft 121 of the geared motor, the signals 118, 119 having a predetermined value. The value of the signal 118 can be selected by means of a decade switch 118A and finally determines the required sliver count.

The open-loop control system "processes" these signals into an output signal 122 which is applied to a multiplier 41 similar to the multiplier 41 of FIG. 6. By way of a line 40 the multiplier 41 receives a signal which has been prepared as described with reference to FIG. 6. The multiplier 41 therefore multiplies the output signal 122 by the signal obtained by way of the line 40, so that the output signal 122 is corrected in accordance with the absolute air humidity. The output signal of the multiplier 41 so determines the speed of the motor 113 in dependence upon variations in lap density in the nip zone 123 that the density of the lap leaving the zone 123 has been substantially evened out. Because of the disturbance variable feedforward produced by the multiplier 41, the open-loop control of lap density has already been corrected to take account of variations in absolute air humidity, so that the sliver 108 finally has the required sliver count unaffected by the absolute air humidity.

The open-loop control 117 may comprise a known and commercially available microcomputer 117*a* such as the microprocessors sold by the company Texas Instruments, under the type designation 990/100MA and having the requisite number of type TMS2716 EPROMS, also made by Texas Instruments, for programming the control functions. Also included is a control unit 117B of a type known in itself and commercially available from the company styled Areg, of Gemmrigheim in the Federal Republic of Germany, under the designation D10 AKNRV 419 D-R. The unit 117B amplifies a speed signal output by the microcomputer to form the output signal 122 and receives the signal 120 for monitoring and controlling feed roller speed.

The entering signal 116 is first processed in a stage 117C. The average of the entering signal is recalculated at regular, closely following, periods of time from a fixed number of the most recently read values. This enables the long-term deviation or drift of the feed to be ascertained if required. The instantaneous value of the entering signal is compared with the average at very short intervals of approximately 100 milliseconds in the stage 117C and the variation is communicated as actual value to the microcomputer 117A. The latter is programmed as a P1 (i.e., proportional, integral) controller and, by means of the control algorithm programmed in the EPROMs and of preprogrammed data specific to the equipment, calculates from the set value of the decades a controlled condition or output quantity y which forms the set value supplied to the Areg controller 117B as diagrammatically indicated by the arrow between the blocks 117A and 117B.

It is also possible in this arrangement to dispose the multiplier 41 between the blocks 117A and 117B so that the set value of the controller 117B is corrected in dependence upon the absolute air humidity. Another possibility is for the functions of the stage 117C to be carried out in the microcomputer by means of appropriate EPROMs or of corresponding programming, so that a separate stage 117C can be omitted.

The controller 117B represents an independent electronic control facility which precedes the motor 113. The set value predetermined by the microcomputer 117A is compared in the electronic control facility with the actual speed value 120 and the difference is amplified and supplied by way of the power circuits to the motor. The facility 117B operates by voltage control and supplies the motor with just sufficient voltage for the motor to output the required torque at the required speed.

Figure 8:
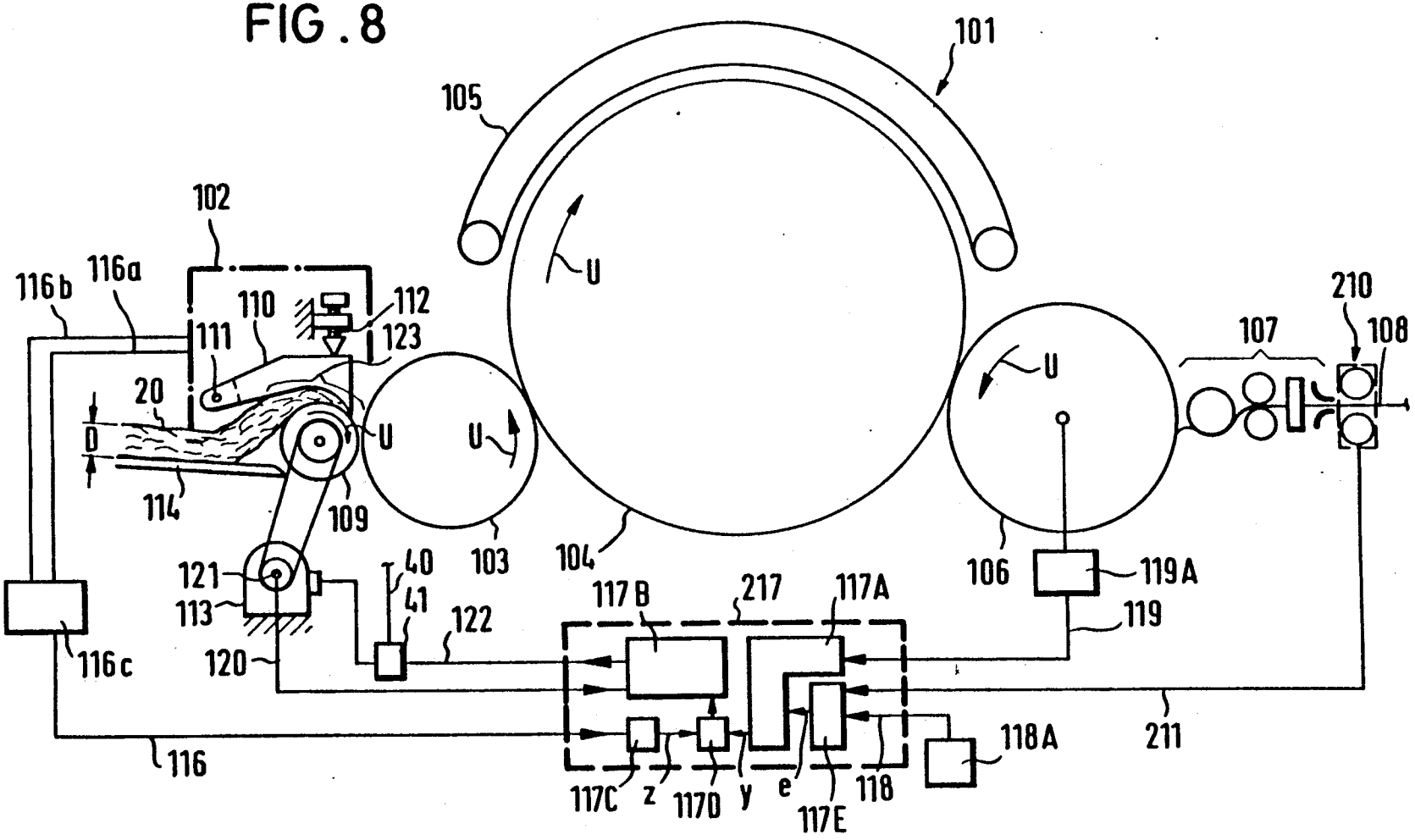
FIG. 8 is a diagrammatic elevation of a card having closed-loop control according to European patent application 87 118 414.9 but having the additional closed-loop control according to the invention.

The card shown in FIG. 8 as having closed-loop control is similar to the open-loop construction of FIG. 7 and like references denote like elements. The common elements will not be further described in detail and the emphasis will be on differences from the construction of FIG. 7.

An important feature of the system shown in FIG. 8 is that, immediately after the condensing unit 107 as considered in the direction of sliver conveyance, a device 210 known from EP-A-00 78 393 senses the weight or density of the sliver and delivers a density signal 211 to a closed-loop control 217. In other words, in the system shown in FIG. 8 any variations in the sliver are detected directly and included in the control 217 so that the sliver density is subjected to closed-loop control. In this example the control 217 receives the following signals: the signal 116, obtained similarly to the signal 116 of FIG. 7, a manually or automatically set input signal 118 for the required sliver count, a speed signal 119 for the doffer 106, a speed signal 120 for the motor shaft 121 and the density signal 211, the signals 118, 119 having preset values as in FIG. 7. As in FIG. 7, the value of the signal 118 can be selected by means of a decade switch 118A.

In this embodiment the control 217 processes these signals into an output signal 122 by means of which the speed of the motor 113 is so corrected, in dependence upon variations in lap density, in the clamping gap zone 123 and in dependence upon the variations detected by the device 210 that the density of the sliver leaving the card 101 can be substantially evened out. Here too, the output signal 120 of the closed-loop control is supplied to the motor not directly but by way of a multiplier 41 in which it is corrected by the correction signal from the line 40 of the air humidity measuring facility 30–39 in accordance with the absolute air humidity.

In this case too, the control 217 mainly comprises the computer 117A, which may be of the type 990/100MA of the company styled Texas Instruments, with the necessary number of type TMS2726 EPROMs, also made by Texas Instruments, for programming the control functions, and a type D10 AKNRV 419D-R control unit 117B made by the company styled Areg, of Gemmrigheim, Federal Republic of Germany. The control unit 117B amplifies the speed signal output by the microcomputer to form the output signal 122 and receives the signal 120 for monitoring and controlling feed roller speed. Here too the set value provided by the microcomputer 117A could first be multiplied by the correction value for absolute air humidity and the corrected set value used as input set value for the controller 117B.

The entering signal 116 is initially processed in the stage 117C. The average of the entering signal is recalculated at regular, closely following, time intervals from a fixed number of the most recently read values. This helps to eliminate long-term variation of the fiber stock. The constantly renewed averaging has the same effect as if a drift filter was present. The instantaneous value of the entering signal is compared in the stage 117C with the most recently obtained average at very brief time intervals of approximately 100 milliseconds by the quotient of the average value and instantaneous value being formed to obtain a signal z showing whether fiber density in the nip is momentarily increasing or decreasing. The signal z can be regarded as a "trend signal". In the next stage 117D, which is a multiplier, the signal z is multiplied by a control signal y from the microcomputer 117A and the result of the multiplication is fed as set value to the controller 117B. In this example the correction value can be supplied by the divider 37—i.e., the correction value for absolute air humidity—to the multiplier 117D too, so that the set value of the controller 117B is corrected correspondingly.

As in the case of FIG. 7 the controller 117B represents an independent electronic control facility preceding the motor 113 The set value determined by the multiplier 117D is compared in the controller 117B with the actual speed value 120 and the difference is amplified and supplied by way of the power circuits to the motor. The controller 117B operates by voltage control and supplies the motor with just sufficient voltage 122 to produce the required torque and speed.

As previously mentioned, the value of the manipulated input signal 118 selected by means of the decade switch 118A represents the required sliver count. This set-value signal 118 is supplied together with an actual value signal for the sliver count or sliver density to the stage 117E which effects a subtraction between the two signals to determine the deviation. This deviation—i.e., the signal z proportional to the deviation—is supplied to the microcomputer 117A embodied in this example by corresponding EPROMs as a P1 controller. The controlled condition y previously mentioned is calculated in the microcomputer 117A in accordance with the following formula:

$$x(t) = K\left[e(t) + \frac{1}{T_X}\int_0^T e(t)dt\right]$$

in which K denotes the proportional component and $T_x$ denotes the integral component.

Also, the tacho initiator 119A measures the speed of the doffer 106. This speed, which should be constant in operation and is controlled to a constant value in operation, is an important value for the microcomputer 117A, more particularly when the arrangement is taken into operation, since the value is not constant at the start of operation and a corresponding start adjustment must be made.

The functions of the stages 117C, 117D, 117B and 117E can of course be carried out if required in the microcomputer 117A provided that the same is programmed appropriately.

Figure 10:
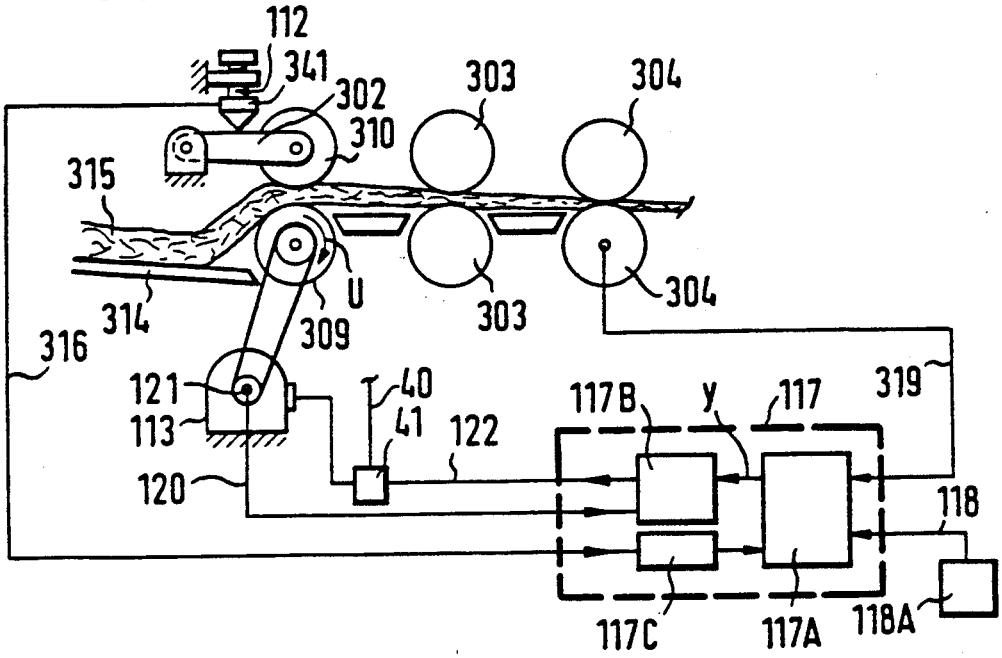
FIG. 10 is a diagrammatic elevation of a drawframe having open-loop control and provision for making the correction according to the invention.

The correction according to the invention can also be used for a drawframe, as will now be described with reference to FIG. 10. FIG. 10 shows a drawframe which has open-loop control and to which a number of overlapping slivers forming a web 315 are supplied on a feed table 314. The slivers first pass through a feed unit for the drawframe, the feed unit being similar to the feed unit 102 shown in FIG. 7. However, a companion roller 310 is used in the present embodiment instead of the trough plate 110 of FIG. 7. The roller 310 cooperates with the feed roller 309 to form the boundary of a clamping gap or nip. Unlike the roller 309 the roller 310 is undriven—i.e., it is freely rotatable and is dragged by the web 315 passing between the rollers 310 and 309

The roller 310 is pivotally and rotatably secured to a pivot lever 302. After passing through the feed unit the web 315 passes through two spaced-apart roller pairs 303 and 304 which are very familiar from the drawframe art and so will not be described any further. It will be mentioned merely in connection with the function of the feed unit that the two bottom rollers (looking at FIG. 10) of the roller pairs 303 and 304 are driven at a fixed speed which produces the draft in the drawframe. The top rollers of the pairs 303 and 304 are dragged by the webs similarly to the roller 310.

In this drawframe the position of the lever 302 and, therefore, of the companion roller 310 is fixed. A signal 316 proportional to the pressing of the web 315 in the nip between the rollers 309 and 310 is produced by a load cell 341 associated with the mechanical limiting device 112.

As will be apparent, the open-loop control 117 of the drawframe of FIG. 10 is of identical construction to the open-loop control 117 of the card of FIG. 7, and so like references denote like elements in FIGS. 7 and 10. The operation of this open-loop control is also to be understood as similar to the operation of the open-loop control of FIG. 7.

If during the feeding of the web 315 different forces arise in the nip, variations occur in the signal 316 which are processed by the control 117, in the manner hereinbefore described with reference to FIG. 7, with a view to so varying the speed of the feed roller 309 that the pressing in the nip remains constant. To this end, the signal 319 transmits the predetermined fixed speed of the bottom roller of the pair 304 to the open-loop control. The signal 118 determines the required sliver count at the drawframe exit and is selected by means of a decade switch 118A. The control 117 also receives the speed signal 120—i.e., the actual-value signal for the motor shaft 121—and controls this speed by means of the output signal 112.

The correction for absolute humidity is effected in this case too by way of the line 40 and multiplier 41. This correction can be made within the open-loop control 117 in the manner hereinbefore described with reference to FIG. 7.

Figure 11:
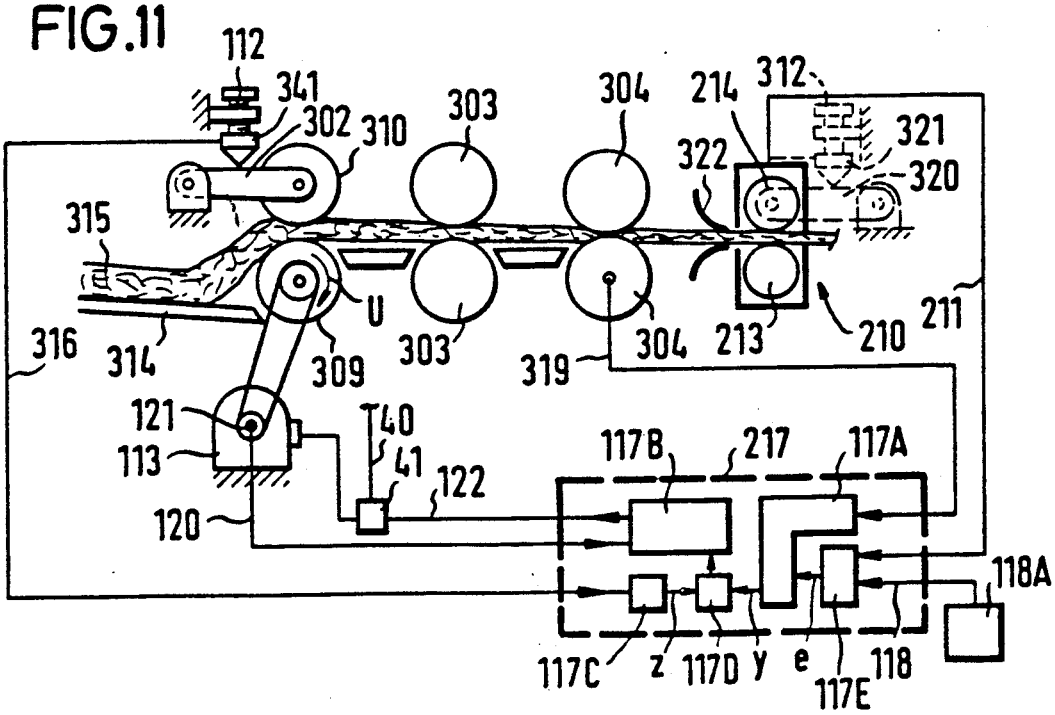
FIG. 11 shows a further development of the drawframe of FIG. 10 in the form of a drawframe having closed-loop control.

FIG. 11 shows another development of a drawframe which in this case has closed-loop control. The basic arrangement of the feed unit and roller pairs is identical to FIG. 10 wherein like elements have like reference numerals, so that this basic arrangement need not be described again here. A device 210 for sensing sliver density and immediately thereafter a condensing funnel 322 are disposed at the drawframe exit. The device 210 is known from EP-A-0 078 393 (counterpart of U.S. Pat. No. 4,539,729) and is identical to the device 210 of FIG. 8.

In other words, the device 210 comprises a pair of rollers which can be pressed together and whose peripheries so engage with one another that a sliver-guiding clamping or nip zone is created. The roller 213 is non-displaceable and the other roller 214 is displaceable for a movement corresponding to variations of sliver density. In practice these motions are sensed by a proximity switch (not shown) and a signal 211 corresponding to density variations is produced.

As a variant (shown in chain lines) the displacement of the roller 214 relatively to the companion roller 213 can be sensed by a load cell 321 integrated in an adjusting screw 213 instead of by a proximity switch. To this end, the roller 214 is rotatably mounted on a pivot lever 320 performing the same function as the pivot lever 302 of FIG. 10. In operation the sliver moving through the funnel 322 opens the rollers 213 and 214 by a predetermined amount until the lever 320 engages the screw 312. The different forces which therefore arise in the stationary nip between the rollers 213 and 214 and which correspond to the different sliver density are detected by the load cell 321 and transmitted as a signal 211 to a closed-loop control 217.

As will be readily apparent from FIG. 11, the control 217 is of identical construction to the corresponding control 217 of FIG. 8 and so like elements have like references. Also, the operation of the overall closed-loop control of FIG. 11 corresponds to that of FIG. 8 and will therefore not be described in detail. Any variations in the sliver are detected directly at the drawframe output by means of the signal 211 and taken into consideration in the control.

As will again be apparent in the present case, the correction according to the invention can be carried out by way of the line 40 and multiplier 41 and these elements may, if required, be incorporated in the control 217 as described with reference to FIG. 8.

What is claimed is:

1. A method of producing continuous slivers of improved uniformity with respect to sliver count in a textile production facility having apparatus for processing fibers into slivers, said method including the steps of:

determining the absolute humidity of air in a vicinity of said apparatus; and controlling said apparatus in response to the absolute humidity to reduce irregularities in the sliver count of the produced slivers due to absolute humidity variations over time in the textile production facility.

2. A method according to claim 1, including controlling said apparatus in response to variations in sliver thickness as well as textile production facility absolute air humidity.

3. A method of producing continuous slivers of improved uniformity with respect to a sliver count of a sliver produced in a textile production facility having an apparatus for processing fibers into slivers, said method including the steps of:

measuring the humidity of air in a vicinity of said apparatus, the measuring of the humidity being carried out to provide a measure of absolute air humidity;

forming an average from the absolute air humidity measured either continuously or at regular time intervals; and, controlling said apparatus in dependence upon progressive variations in such average to reduce irregularities in the sliver count of the produced slivers due to humidity variations over time in the textile production facility.

4. A method according to claim 3, wherein said average is formed from measurements taken over lengths of time in a range from about twenty to about forty minutes.

5. A method according to claim 4, wherein said measurements are made periodically at intervals of about one minute and said average is formed from measurements taken over about thirty minutes.

6. An apparatus for processing fibers into slivers of improved uniformity with respect to sliver count in a textile production facility, said apparatus comprising:

means for determining the absolute humidity of air in a vicinity of said apparatus;

a stock chute feed having regulatable means for varying the amount of fiber delivered therefrom per unit of time;

a card for receiving fiber from said stock chute feed; and a closed-loop control system for regulating said regulatable means to minimize variations in the sliver count of a sliver produced by said apparatus and for controlling said apparatus in response to the absolute humidity to reduce irregularities in the sliver count of the produced slivers due to absolute humidity variations over time in the textile production facility, wherein the controlling of said apparatus in response to absolute humidity is superimposed on said closed-loop control system.

7. An apparatus according to claim 6, wherein said controlling of said apparatus in response to absolute humidity is effected by adjustment of said regulatable means to vary the amount of fiber delivered therefrom per unit of time.

8. An apparatus according to claim 6, wherein said apparatus includes a number of cards receiving fiber from a number of stock feed chutes and the same correction is used for all of said stock chutes.

9. An apparatus according to claim 6, additionally comprising an open-loop control system superimposed on said closed-loop control system, and wherein said card includes a taker-in and said regulatable means includes a feed roller for feeding fiber to said taker-in, and wherein said control systems are operable to regulate the speed of rotation of said feed roller.

10. An apparatus for processing fibers into slivers of improved uniformity with respect to sliver count in a textile production facility, said apparatus comprising:

means for determining the absolute humidity of air in a vicinity of said apparatus;

a drawframe having a regulatable means for varying the amount of entering fiber per unit of time; and a closed-loop control system for regulating said regulatable means to minimize variations in the sliver count of a sliver produced in said drawframe and for controlling said apparatus in response to the absolute humidity to reduce irregularities in the sliver count of the produced slivers due to absolute humidity variations over time in the textile production facility, wherein said controlling of said apparatus in response to absolute humidity is superimposed on said closed-loop control system.

11. An apparatus according to claim 9, additionally comprising an open-loop control system superimposed on said closed-loop system, and wherein said regulatable means is a feed roller.

12. Apparatus for producing continuous slivers of improved uniformity with respect to sliver count in a textile production facility, said apparatus comprising:

a stock chute feed;

processing means disposed after said stock chute feed for producing a sliver from fibers from said stock chute feed; and a control system, said control system further comprising:

means for determining the absolute air humidity in the vicinity of said stock chute feed and said processing means; and means operable in response to detected variations in an average absolute air humidity for controlling said stock chute feed.

13. Apparatus according to claim 10, wherein said control system includes means for sensing variations in sliver thickness and said means for controlling said stock chute feed is operable in response also to variations in sliver thickness.

14. Apparatus according to claim 11, wherein said means for controlling said stock chute feed controls stock feeding by varying pressure applied to flocks in the feed chute, by closed-loop control of the output pressure of a fan delivering the flocks into the chute.

15. Apparatus according to claim 11, wherein said means for controlling said stock chute feed controls stock feeding by closed-loop control of a gap between chute draw-off rollers at the exit of the chute or of their speed of rotation.

16. Apparatus for producing continuous slivers of improved uniformity with respect to sliver count in a textile production facility, said apparatus comprising:

a drawframe for producing a sliver, said drawframe further including input means the speed of which is regulatable; and, a control system which further comprises:

means for determining the existing absolute air humidity in the vicinity of said drawframe; and, means operable in response to detected variations in an average absolute air humidity for controlling said drawframe input means to reduce irregularities in the sliver count of a produced sliver.

17. Apparatus according to claim 16, wherein said means for controlling said drawframe input means is a closed-loop system operable in response to variations in sliver thickness as well as textile production facility absolute air humidity.

18. Apparatus for producing continuous slivers of improved uniformity with respect to a sliver count of a sliver produced in a textile production facility comprising:

a drawframe for producing a sliver, said drawframe further including input means the speed of which is regulatable; and, a control system which further comprises:

at least one detector disposed near said drawframe for measuring existing absolute air humidity; and, means for controlling said drawframe input means in dependence upon detected variations in an average absolute air humidity, wherein said control system is an open-loop system controlling the speed of rotation of a feed roller preceding a pair of back rolls in the drawframe.

* * * * *